US007151212B2

(12) United States Patent
Nagaoka et al.

(10) Patent No.: US 7,151,212 B2
(45) Date of Patent: Dec. 19, 2006

(54) COMPACT KEYBOARD APPARATUS WITH ACCURATE DETECTION OF KEY PRESSING SPEED

(75) Inventors: Yasunori Nagaoka, Shizuoka-ken (JP); Shiro Uno, Shizuoka-ken (JP); Shinichi Matsumoto, Shizuoka-ken (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 11/408,815

(22) Filed: Apr. 21, 2006

(65) Prior Publication Data

US 2006/0254406 A1 Nov. 16, 2006

Related U.S. Application Data

(63) Continuation of application No. 11/023,807, filed on Dec. 28, 2004, now Pat. No. 7,060,883.

(30) Foreign Application Priority Data

Jan. 26, 2004 (JP) ..... 2004-016493
Jan. 26, 2004 (JP) ..... 2004-016760

(51) Int. Cl.
*G10C 3/12* (2006.01)
*G10H 5/00* (2006.01)

(52) U.S. Cl. ..... 84/423 R; 84/434; 84/436; 84/658; 84/745

(58) Field of Classification Search ..... 84/423 R, 84/434, 436, 658, 745
See application file for complete search history.

(56) References Cited

U.S. PATENT DOCUMENTS 3,657,459 A 4/1972 Peterson et al.
3,979,990 A 9/1976 Hinago
5,107,748 A 4/1992 Muramatsu et al.
5,237,125 A 8/1993 Fields
5,453,571 A 9/1995 Adachi et al.
5,552,561 A 9/1996 Nakada et al.
5,567,902 A 10/1996 Kimble et al.
5,841,050 A 11/1998 Clift et al.
5,945,617 A * 8/1999 Niitsuma ..... 84/423 R
6,002,078 A * 12/1999 Yoshinaga et al. ..... 84/436
6,121,535 A 9/2000 Muramatsu
6,365,820 B1 * 4/2002 Kondo et al. ..... 84/658
2003/0227341 A1 12/2003 Swada

FOREIGN PATENT DOCUMENTS

JP 09-274482 4/1996
JP 2002-062876 2/1997
JP 2003-295863 10/2003
JP 2004-015387 1/2004

OTHER PUBLICATIONS

Published photograph of Novation MIDI CON product, no date.
Documents and Photographs describing MK-425C product including User Guide, no date.

* cited by examiner

*Primary Examiner*—Lincoln Donovan
*Assistant Examiner*—Christina Russell
(74) *Attorney, Agent, or Firm*—Foley & Lardner LLP

(57) ABSTRACT

A keyboard apparatus is provided with a key unit that has a plurality of keys supported for pivotal motion. Also provided is a detection section for detecting a key speed when any of the keys are pivoted. The key unit and detection section are supported by a housing having a bottom member formed of a resin. A reinforcing member having a sufficient rigidity is provided to reinforce the bottom member of the housing such as to reduce warping of the bottom member so as to reduce movement of the detection section as a result of warping of the bottom member.

33 Claims, 7 Drawing Sheets

COMPACT KEYBOARD APPARATUS WITH ACCURATE DETECTION OF KEY PRESSING SPEED

CROSS-REFERENCE TO RELATED PATENT APPLICATIONS

This application is a Continuation of U.S. patent application Ser. No. 11/023,807, filed Dec. 28, 2004 now U.S. Pat. No. 7,060,883, which claims priority to Japan Priority Application 2004-016760, filed Jan. 26, 2004, and which claims priority to Japan Priority Application 2004-016493, filed Jan. 26, 2004. U.S. patent application Ser. No. 11/023,807, including the specification, drawings, claims, and abstract, is incorporated herein by reference in its entirety. Japan Priority Application 2004-016760, including the specification, drawings, claims, and abstract, is incorporated herein by reference in its entirety. Japan Priority Application 2004-016493, including the specification, drawings, claims, and abstract, is incorporated herein by reference in its entirety.

BACKGROUND OF THE INVENTION

1. Field of the Invention

Embodiments of the present invention relate to a keyboard apparatus for the performance of music and, in particular embodiments, to a keyboard apparatus with which the input of performance information and the like to a computer is possible.

2. Related Art

In the past, electronic musical instruments have been proposed that are furnished with a keyboard and a sound source, and with which it is possible to easily play the keyboard and enjoy music. On the other hand, using a personal computer, the creation of new pieces and the editing of already existing pieces can be carried out. In addition, personal computers possess the capability to produce musical tones by means of the execution of programs that are known as so-called soft synthesizers, and keyboard apparatuses with which it is possible to carry out a performance with a feeling such as that of a personal computer keyboard for the input of letters and the like in order to input performance data are desired.

For this kind of keyboard apparatus, one that is especially compact and thin and, moreover, that has a key stroke that is short compared to an ordinary keyboard but accurately detects the key pressing speed and the key releasing speed is demanded.

For example, with the keyboard apparatus that is disclosed in Japanese Laid-Open Patent Application Publication (Kokai) Number Hei 9-274482 (Patent Reference 1), a thin type keyboard apparatus is disclosed where at least an octave of keys is formed as a unit in which a plurality of white keys and black keys are formed in a process in which the keys are pressed from a thin steel plate and the intervals between the mutually adjoining keys are removed by excising processing.

In addition, in Japanese Laid-Open Patent Application Publication (Kokai) Number 2002-62876 (Patent Reference 2), a keyboard apparatus is disclosed in which a key unit that comprises the key main body, the key support section, and a connecting section that connects the key main body to the key support section so that the key is free to swing, is formed as one body with a resin. With the key unit, since the resin is poured from the rear end of the key main body or the connection section at the time that the unit is formed, the flow of the resin in the mold becomes uniform and it is possible to improve the strength of the key.

However, in a keyboard apparatus that has been disclosed in Patent Reference 1, since a plurality of white keys and black keys are processed by press processing in a single unit from a thin steel plate and following that, the keys are formed by the intervals between the mutually adjoining keys being removed by excising processing, the side walls do not exist for the keys. Accordingly, because, in particular when a white key is pressed down, the space between the key and the adjoining key is opened greatly, the appearance is poor and, together with this, because the corner of the key that adjoins the key that has been pressed down may be entangled by the finger, there has been the problem that it is not possible to carry out an agile performance.

In addition, with the invention that has been disclosed in Patent Reference 2, the operability of the keys can be improved, but there has been the problem that it is not possible to form the keyboard apparatus compactly and thin.

In addition, the rubber switch of the keyboard apparatus that is disclosed in Patent Reference 1 can detect the key pressing speed, but the touch feeling is poor. There have especially been the problems that the feeling of the force pushing back against the finger at the time that the keyboard has been pressed is not satisfactory and, together with this, chattering is produced when the fixed contact and the moveable contact come into contact and it is difficult to accurately detect the key pressing speed. In particular, in order to detect the key pressing speed, it is configured such that in response to the pressing down of a key, first, the first moveable contact and the first fixed contact come into contact and, next, the second moveable contact and the second fixed contact come into contact. Because of this, after the first moveable contact and the first fixed contact have come into contact, even during a time that the key is pressed down further and the second moveable contact and the second fixed contact come into contact, it is necessary that the first moveable contact be stabilized and the pressing on the first fixed contact be continued.

However, after the first moveable contact and the first fixed contact have come into contact, distortion is produced by a process in which the key is pressed down further and the area that the first moveable contact presses is deformed and chattering occurs. In particular, when the second moveable contact comes into contact with the second fixed contact and the area that is pressed by the second moveable contact begins to deform, the first moveable contact is affected.

In addition, there is a need to provide a click sensation for the key, but it is also necessary that the key rotate smoothly to the lowest portion after the click sensation has been imparted and a keyboard apparatus having a satisfactory operating sensation be made.

SUMMARY OF THE DISCLOSURE

Embodiments of the present invention address problems as described above and relate to a keyboard apparatus for which the operating sensation is satisfactory, that is thin, and with which it is possible to detect the key pressing speed with good accuracy.

A keyboard apparatus in accordance with a first embodiment is furnished with a key unit that has a plurality of keys that are free to swing, and a detection section for the detection of the key speed in those cases where any of the keys has been operated, and a bottom plate member that accommodates the key unit and detection section and that has been formed of a resin, and a reinforcing member, which has rigidity, that reinforces the bottom plate member, and the reinforcing member has a bottom surface that is at least the width of all of the keys that are possessed by the keyboard apparatus for one side and at least the length of a black key for the other side, and the bottom surface and the inside flat surface of the bottom plate member are tightly joined and fixed and attached.

A keyboard apparatus in accordance with a second embodiment is one in which the reinforcing member is processed bent roughly vertically and bent further to be parallel to the bottom surface of the reinforcing member forming a key guide.

A keyboard apparatus in accordance with a third embodiment is one in which the keys have a key guide hole having a cross-section shape for the surface that is perpendicular to the long direction of the key that is rectangular, and the guide regulates the left to right position of the key by means of the two vertical sides of the rectangular key guide hole and, together with this, the position of the key in those cases where the key has been released is regulated by the bottom side of the rectangular key guide hole and the position of the key in those cases where the key has been pressed is regulated by the top side of the rectangular key guide hole.

A keyboard apparatus in accordance with a fourth embodiment is furnished with a key stop with which the key is stopped in those cases where the key has been pressed and the key stop is stamped out of the reinforcing member that has rigidity and is formed on the bottom plate member.

A keyboard apparatus in accordance with a fifth embodiment is one in which the reinforcing member that has rigidity is stamped out of a steel plate and has been bent.

A keyboard apparatus in accordance with a sixth embodiment is one in which the reinforcing member forms a rib by the bending of the outer periphery.

A keyboard apparatus in accordance with a seventh embodiment is, in a keyboard apparatus that has been furnished with a driven section that comprises a cylindrical section that has a moveable contact on the inside, and a switch that is formed from an elastic material in a single unit with a skirt section that supports the driven section, and a key, which is free to swing, that drives the driven section, and a base plate that has a fixed contact, which has been formed opposite the moveable contact, one in which, in the state in which the key has started to drive the driven section of the switch, an open gap is disposed between the upper surface of the moveable contact of the switch and the area that corresponds to the moveable contact of the key, and after the moveable contact has come into contact with the fixed contact as a consequence of the pressing of the key, the area that corresponds to the moveable contact of the key comes into contact with the upper surface of the moveable contact.

A keyboard apparatus in accordance with an eighth embodiment is one in which a protrusion from the elastic material with which the switch is configured is disposed on the top of the moveable contact of the switch.

A keyboard apparatus in accordance with a ninth embodiment is one in which a protrusion is disposed on the area that is opposite the moveable contact of the switch on the side of the key.

A keyboard apparatus in accordance with a tenth embodiment is, in a keyboard apparatus that has a driven section comprising a first cylindrical section that has a first moveable contact and a second cylindrical section that has a second moveable contact, and a switch that is formed from an elastic material in a single unit with a skirt section that supports the driven section, and a key, which is free to swing, that drives the driven section, and a base plate that has a first fixed contact that has been formed opposite the first moveable contact and a second fixed contact that has been formed opposite the second moveable contact, and that has been configured such that first, the first moveable contact comes into contact with the first fixed contact and then the second moveable contact comes into contact with the second fixed contact in conformance with the pressing down of the key, one in which, in a state in which the driving of the driven section of the switch by the key has been started, an open gap is disposed between the first moveable contact and the area of the key that corresponds to the first moveable contact, and after the first moveable contact has come into contact with the fixed contact in conformance with the pressing down of the key, the area that corresponds to the first moveable contact of the key comes into contact with the upper surface of the first moveable contact.

A keyboard apparatus in accordance with an eleventh embodiment is one in which, in the state in which the driving of the driven section of the switch has been started by the key, an open gap is disposed between the first moveable contact and the area of the key that corresponds to the first moveable contact, and after the first moveable contact has come into contact with the first fixed contact in conformance with the pressing down of the key, at roughly the time that the second moveable contact comes into contact with the second fixed contact, the area that corresponds to the first moveable contact of the key comes into contact with the upper surface of the first moveable contact.

A keyboard apparatus in accordance with a twelfth embodiment is one in which a protrusion from the elastic material with which the switch is configured is disposed on the top of the first moveable contact of the switch.

A keyboard apparatus in accordance with a thirteenth embodiment is one in which a protrusion is disposed on the area that is opposite the first moveable contact of the switch on the side of the key.

By means of a keyboard apparatus in accordance with the first embodiment, since the keyboard apparatus is furnished with a reinforcing member, which has rigidity, that reinforces the bottom plate member that is formed from a resin and the reinforcing member has a bottom surface that on one side is at least the width of all of the keys of the keyboard apparatus and on the other side is at least the length of a black key, and the bottom surface and the inside flat surface of the bottom plate member are tightly joined and fixed, there is the advantageous result that because the resin is made to have rigidity, it is possible to detect the key speed with good accuracy and, together with this, the keyboard apparatus can be formed thin.

By means of a keyboard apparatus in accordance with the second embodiment, since a key guide is formed by bending the reinforcing member roughly vertically and then further bending the member so that the leading edge section is parallel to the bottom surface of the reinforcing member, there is the advantageous result that the number of components is reduced and, together with this, because the member is formed in the pressing process, it is possible to supply it cheaply.

By means of a keyboard apparatus in accordance with the third embodiment, since the cross-section shape of the vertical surface in the long direction of the key is a rectangular key guide hole, and the key guide regulates the left to right position of the key by means of the two vertical sides of the rectangular hole and, together with this, regulates the position in those cases where the key is released by means of the bottom side of the rectangular key guide hole and regulates the position in those cases where the key has been pressed by means of the upper side of the key guide hole, it is possible to regulate the movement of the key in the left to right direction and the up and down direction and thus, there is the advantageous result that the number of components is small and the configuration is simple and, together with this, because the key structure can be made simple, it is possible to make the key thin.

By means of a keyboard apparatus in accordance with the fourth embodiment, since the key stop, with which the key is stopped in those cases where the key has been pressed down, has been formed on the bottom plate member by being stamped out of the reinforcing member, there is the advantageous result that the keyboard apparatus can be made thin.

By means of a keyboard apparatus in accordance with the fifth embodiment, since the reinforcing member that has rigidity has been stamped out and bent by the pressing of a steel plate, there is the advantageous result that the reinforcing member can be formed cheaply.

By means of a keyboard apparatus in accordance with the sixth embodiment, since the reinforcing member forms a rib by the bending of its outer periphery, there is the advantageous result that it is possible to increase the rigidity of the reinforcing member by means of a simple processing method.

By means of a keyboard apparatus in accordance with the seventh embodiment, since it is configured such that in the key releasing state, an open space is provided between the driven surface and the upper surface of the moveable contact and after the moveable contact has come into contact with the fixed contact as a consequence of the key pressing, the key comes into contact with the upper surface of the moveable contact, there is the advantageous result that in those cases where the key is pressed down, it is possible for the moveable contact to be reliably pressed against the fixed contact after the moveable contact has come into contact with the fixed contact and, thus, the occurrence of chattering can be prevented.

By means of a keyboard apparatus in accordance with the tenth embodiment, since after the first moveable contact has come into contact with the fixed contact, the upper surface of the first moveable contact comes into contact with the key and when the key is pressed down further, the second moveable contact comes into contact with the fixed contact, there is the advantageous result that it is possible to prevent chattering between the first moveable contact and the fixed contact and, thus, it is possible to detect an accurate key speed.

By means of a keyboard apparatus in accordance with the eleventh embodiment, after the first moveable contact has come into contact with the first fixed contact, the second moveable contact comes into contact with the second fixed contact and there is the advantageous result that it is possible to prevent the occurrence of chattering by the first moveable contact caused by the second moveable contact.

By means of a keyboard apparatus in accordance with the eighth or twelfth embodiments, since on the upper surface of the moveable contact of the switch, a protrusion from the elastic material that configures said switch is disposed, there is the advantageous result that it is possible to prevent chattering with a simple configuration and, together with this, since the protrusion is an elastic material, the force pushing back in those cases where the key has been pressed down is dampened and the operating sensation is satisfactory.

By means of a keyboard apparatus in accordance with the ninth or thirteenth embodiments, there is the advantageous result that it is possible to prevent chattering with a simple configuration in which a protrusion is formed on the key.

DETAILED DESCRIPTION OF PREFERRED EMBODIMENTS

Figure 1:
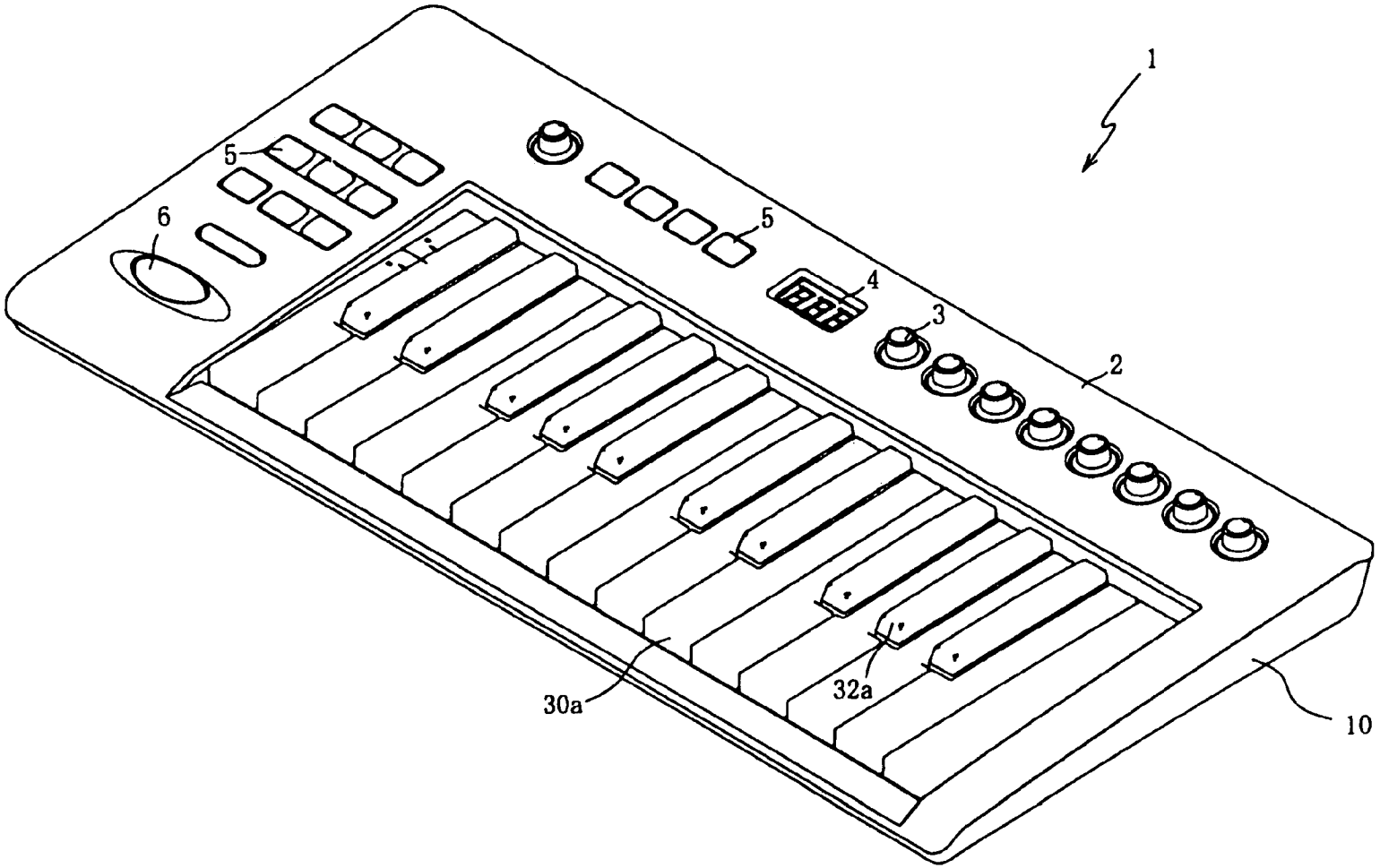
FIG. 1 is an exterior oblique view drawing of a keyboard apparatus in accordance with an embodiment of the invention.

Explanations will be given below regarding embodiments while referring to the attached drawings. FIG. 1 is an exterior oblique view drawing of an application illustration of a keyboard apparatus 1 in accordance with a preferred embodiment of the invention. In the exterior oblique view drawing, an upper panel 2 that is furnished with a plurality of volume control knobs 3, a display device 4, a plurality of switches 5, and a bender 6 as well as a keyboard section of two octaves (actually there are two octaves plus one key) that are configured by a plurality of white keys 30*a* and black keys 32*a*, and a bottom plate member 10 are shown.

In addition, although they are not shown in the drawing, the rear surface of the keyboard apparatus 1 is furnished with an electric power switch and various types of jacks. The types of jacks that the keyboard apparatus is furnished with are jacks for carrying out the input and output of MIDI signals and the communication of digital audio signals, USB (universal serial bus), which is a personal computer communications standard, audio signal input and output jacks, and jacks for headphones.

The keyboard apparatus 1 is one that is primarily employed with the aim of the production and editing of performance data using a personal computer and is made compact and thin so that it can be used on top of a desk but can accurately detect the key pressing speed (velocity). In particular, with this keyboard apparatus 1, in order to make the apparatus thin, the stroke of the keys is set shorter than the stroke for an ordinary keyboard.

In addition, the keyboard apparatus 1 is furnished with a microcomputer that is configured by a CPU, a ROM, a RAM, and the like that are not shown in the drawing; and when the keys and the various kinds of operators are operated by the performer, the operating states of these are detected and such MIDI messages as the note on and off and control change are output via the USB. The personal computer that has been connected to the keyboard apparatus 1 via the USB receives the MIDI message and transmits the digital audio signal that corresponds to the MIDI message via the USB. The keyboard apparatus 1 is furnished with a D/A converter and the digital audio signal is converted into an analog audio signal and can be heard by the performer using headphones and the like.

The various types of volume control knobs 3 adjust the volume of the audio signal and can set other parameters as desired. It is possible to assign the MIDI messages to the volume control knobs 3 with which the parameters are set.

The display device 4 displays the MIDI channels that have been set and the values of the parameters, and three digits of seven segments as well as dots that indicate various types of functions and the like are configured using an LCD.

The various types of switches 5 assign the MIDI channels to the operators of the keyboard and the like and set the functions and the like that assign the MIDI messages to the volume control knobs 3 that set the parameters discussed above.

The bender 6 is an operator with which a swinging operation is possible in the direction that the keys are lined up and at those times that no operation has been done by the operator, the bender is maintained in the center. When the bender is operated in the left direction or the right direction, the bender information for the MIDI message that is the control signal with which the pitch of the musical tone is controlled down or up is output.

These various types of volume controls 3, the display device 4, the switches 5, and the bender 6 are soldered to a printed circuit board that is not shown in the drawing and the printed circuit board is screwed onto the upper panel 2, which is formed from a resin.

Figure 2:
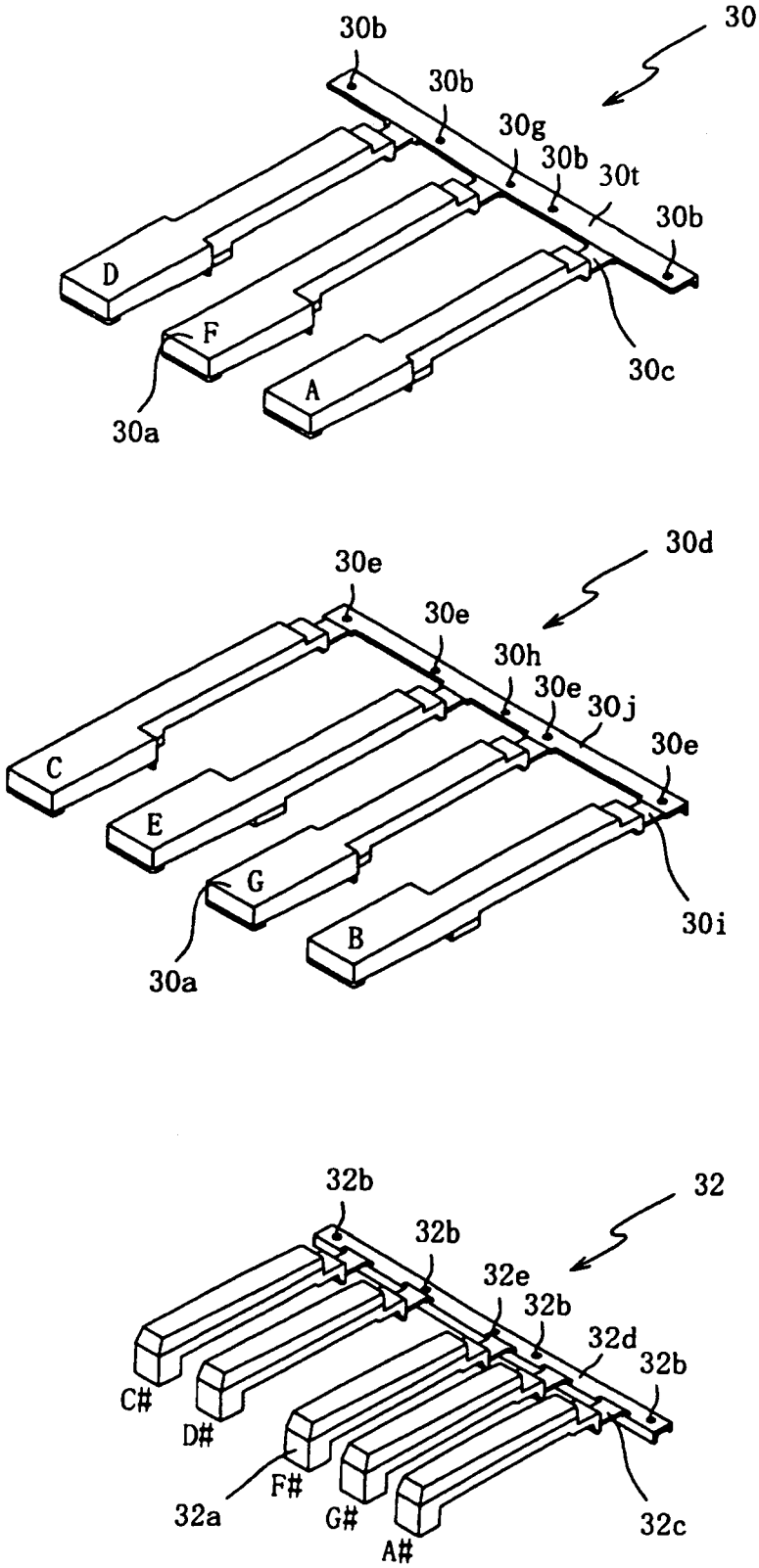
FIG. 2 is a disassembled oblique view drawing of keys of an embodiment of the invention.

FIG. 2 is a disassembled oblique view drawing of the keys and one octave of a keys is configured by the two types of white key units 30 and 30*d* and a single type of black key unit 32. The white key unit 30 comprises the three white keys 30*a* with the note names D, F, and A, the hinge sections 30*c*, which are connected to the rear ends of the white keys 30*a* so that they are free to swing, and the key support section 30*t*, which extends in the direction that the keys are lined up and having the hinge sections 30*c* interposed, formed in a single unit with a resin. In the same manner, the white key unit 30*d* comprises the four white keys 30*a* with the note names C, E, G, and B, the hinge sections 30*i*, and the key support section 30*j* formed in a single unit with a resin; and the black key unit 32 comprises the five black keys 32*a* with the note names C#, D#, F#, G#, and A#, the hinge sections 32*c*, and the key support section 32*d* formed in a single unit.

The key support sections of the three key units are superposed in the order from the bottom of the black key unit 32, the white key unit 30*d*, and the white key unit 30 and are fixed to the key base section 10*b*, which has been formed on the bottom plate member 10 (refer to FIG. 3) with screws. At that time, the guide holes 32*e* of the black key unit 32, the guide hole 30*h* of the white key unit 30*d*, and the guide hole 30*g* of the white key unit 30 are fit onto the guide pin 10*c* that has been disposed on the key base section 10*b*, the screws are inserted into the screw holes 32*b* of the black key unit, the screw holes 30*e* of the white key unit 30*d*, and the screw holes 30*b* of the white key unit 30, and screwed into the screw holes that have been disposed in the key base section 10*b*.

For the keyboard apparatus 1 that is shown in FIG. 1, a keyboard apparatus of 25 keys comprising two octaves plus one white key has been presented and, in this case, one set of a low octave key region comprises the white key units 30 and 30*d* and the black key unit 32 that has been described in the explanation given above, and one more key region set comprises a key unit having one more white key (note name C) added to a white key unit 30, as well as a white key unit 30*d* and a black key unit 32.

Figure 3:
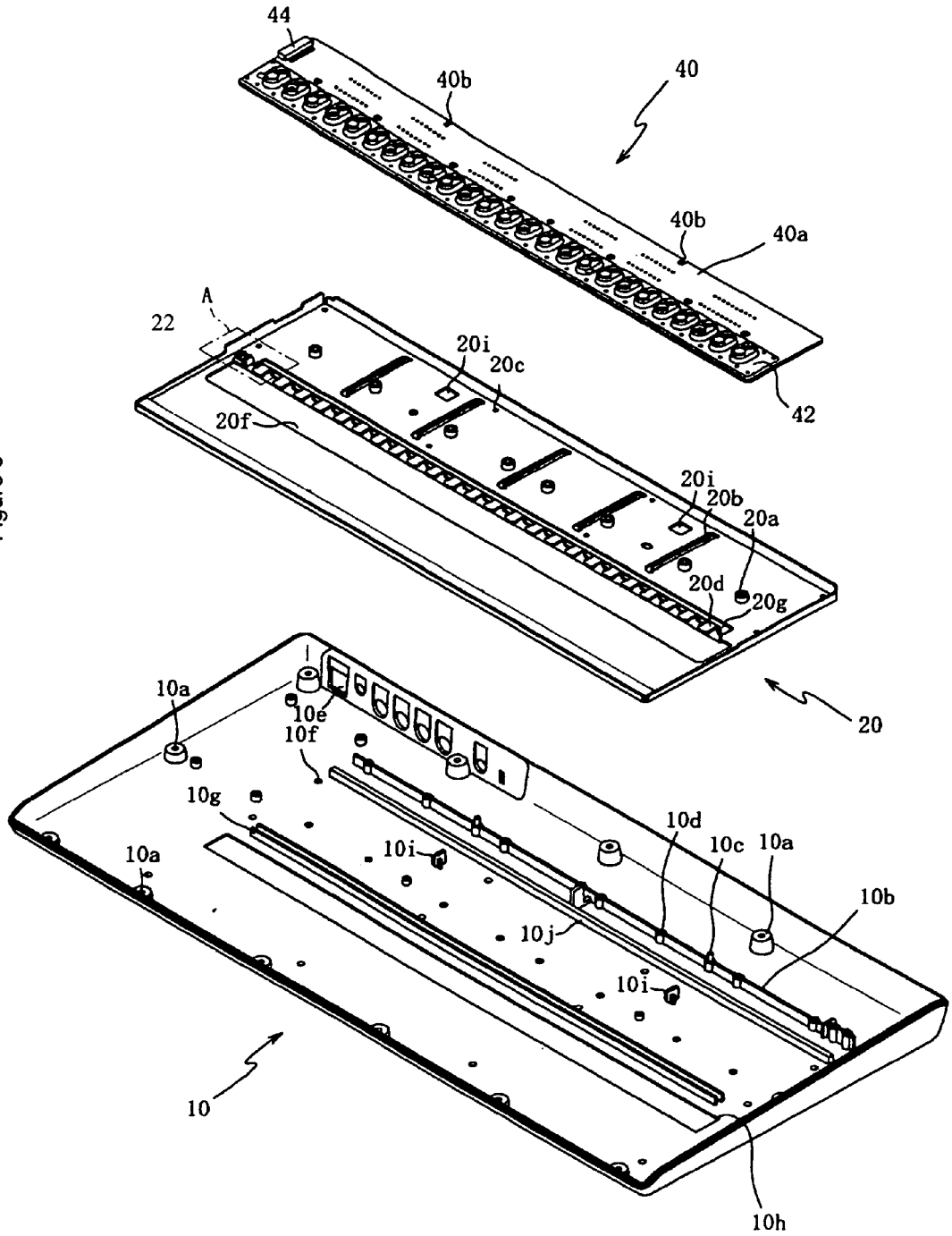
FIG. 3 is a disassembled oblique view drawing of a base plate, a reinforcing member, and a bottom plate member of an embodiment of the invention.

FIG. 3 is a disassembled oblique view drawing of the bottom plate member 10, a reinforcing member 20, and a switch base plate section 40. The switch base plate section 40 comprises a plurality of rubber switches 42 that have two moveable contacts with which, in those cases where any of the keys has been pressed down, a time difference that conforms to the key speed is conducted, and a printed wiring board 40*a* on which has been formed the wiring circuit for the detection of the conduction state of those switches.

The slits 40*b* that are mated to the protrusions 10*i* for positioning, which are disposed on the bottom plate member 10, are disposed in the printed wiring board such that each of the switches is arranged in a position that corresponds to each of the keys at the time that the board is attached to the reinforcing member 20. In addition, the connectors 44 for the wiring for the detection of the connection state of each of the switches are soldered to the printed wiring board 40*a*.

The reinforcing member 20 is a member that has been press processed from a steel plate and is fixed to the bottom plate member 10, which has been formed from a resin, with screws. Because the bottom plate member 10 is formed using a resin, the member is cheap and light and also has satisfactory producability, but is easily warped and changes over time are likely to occur especially due to temperature changes and the like. Because of this, it is difficult to detect the key pressing speed with satisfactory accuracy using a resin only. Therefore, with the keyboard apparatus of the present invention, the entire bottom surface of the reinforcing member 20, which is made from steel plate, is affixed to the flat surface of the bottom plate member 10 and due to the fact that the reinforcing member is solidly attached, the warping and deformation of the bottom plate member 10 is prevented. The width of the bottom surface of the reinforcing member 20 is at least the width of the all of the keys that are possessed by the keyboard apparatus 1 (25 keys in this preferred embodiment) and the depth is at least the length of a black key. Due to this fact, the flatness of the keyboard apparatus 1 in the direction of the width can be ensured and, together with this, with regard to the direction of the depth, it is possible to ensure rigidity between the switches with which the speed of the key is detected from the fulcrum of the key and the speed can be detected with good accuracy. In this preferred embodiment, in order to further ensure the rigidity of the bottom plate member 10, the depth of the bottom surface of the reinforcing member 20 has been made nearly the length of a white key.

A self tapping screw is inserted into the screw hole 10*f* that has been opened in the flat surface of the bottom section of the bottom plate member 10 and is screwed from direction of the bottom of the bottom plate member 10 into the screw hole 20*c* that has been disposed in the reinforcing member 20.

Along the entire periphery of the reinforcing member 20, the steel plate is bent at a right angle to the bottom surface, obtaining strength and, together with this, the rib 20*b* is formed by stamping out and bending the steel plate in five places, acquiring additional strength.

In addition, the key guide 20*d*, which has been formed by the bending of the reinforcing member 20, is formed in the center of the reinforcing member 20, and the long hole 20*f* that has been punched out of the steel plate in order to form the key guide 20*d* is formed (discussed later). The base plate bearer 10*g* that supports the printed wiring board 40*a* is formed on the bottom plate member 10 and the clearance hole 20*g*, which provides clearance for the base plate bearer 10*g*, and the clearance holes 20*i*, which provide clearance for the protrusions 10*i* for the positioning of the printed wiring board 40*a*, are formed. For the steel plate that is employed for the reinforcing member 20, one that has had corrosion proof treatment such as zinc plating is preferable.

The bottom plate member 10 is the bottom plate of this keyboard apparatus 1 and the housing for this keyboard apparatus 1 is formed by fixing and attaching the upper panel 2 with screws. A plurality of bosses 10*a* that have screw holes are formed on the outer periphery of the bottom plate member 10 and are fixed and attached with screws to bosses that are formed on the upper panel 2 in positions that correspond to these bosses 10*a*. In addition, on the rear of the bottom plate 10, the pass through holes 10*e*, in which the various types of jacks are arranged, are formed in a plurality. In addition, as will be discussed later, the base plate bearer 10*g* that supports the printed wiring board 40 and the protrusions 10*j* that support the fulcra of the keys are disposed extending in the direction that the keys are lined up, and the depression 10*h*, in which the key stopper 12 (shown in FIG. 4) and the protrusion 10*i* for the positioning that is carried out in those cases where the printed wiring board 40*a* is assembled and attached are affixed, is formed.

Figure 4:
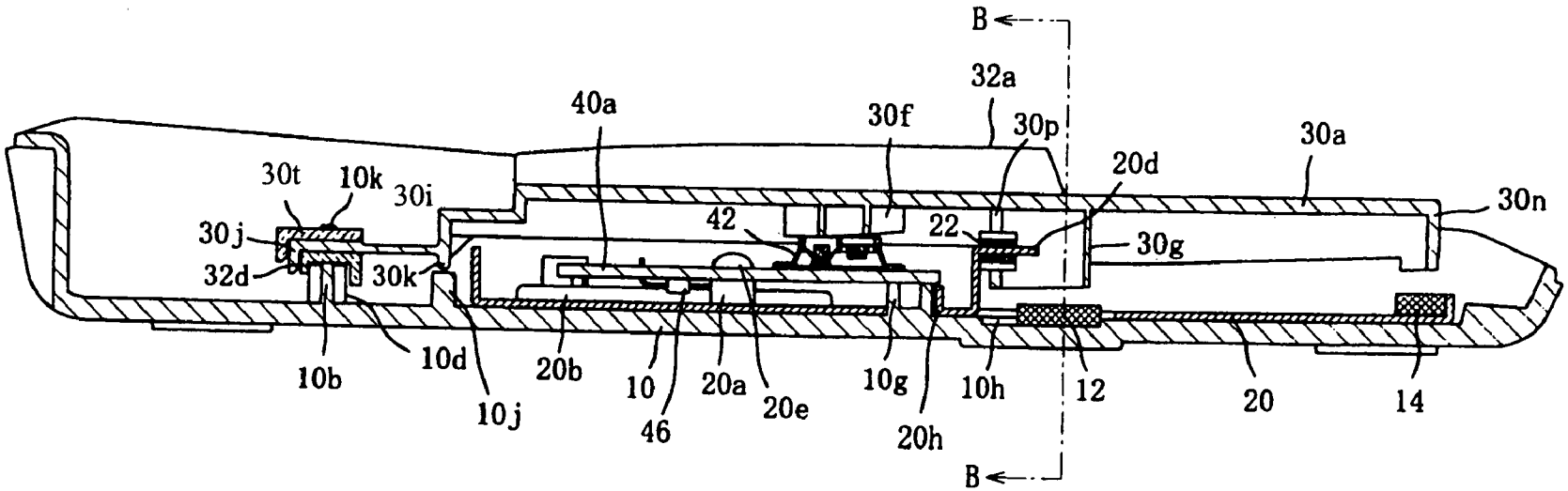
FIG. 4 is an assembled cross-section drawing of a white key of an embodiment of the invention.

FIG. 4 is a drawing in which the reinforcing member 20, the printed wiring board 40*a*, and the key units 30, 30*d*, and 32 have been assembled and attached to the bottom plate member 10 of this keyboard apparatus, and shows a cross-section view in the direction of the length of the keys of a white key 30*a* of the white key unit 30*d*. As discussed above, the reinforcing member 20 is assembled and attached to the bottom plate member 10, the printed wiring board 40*a* is installed on the reinforcing member 20, a circuit is disposed on the printed wiring board 40*a* for the detection of the connection state of each switch, and the diodes 46 that configure the circuit are soldered.

The printed wiring board 40*a* is inserted into the holes that have been disposed on the bottom of the reinforcing member 20, arranged on the nuts 20*a* that are formed from brass that has been fixed and attached by means of caulking and on the base plate bearer 10*g*, which is a protrusion that has been formed on the bottom plate member 10, and is screwed down by means of the screws 20*e*. The base plate bearer 10*g* is adhered to the printed wiring board 40*a* using double sided tape and supports the load that is applied to the rubber switches 42 that have been disposed on the printed wiring board 40*a* in those cases where a key has been pressed down.

The clearance hole 20*g* (shown in FIG. 3), which provides clearance for the base plate bearer 10*g*, is formed in the reinforcing member 20; and, together with this, the rib 20*h* is formed from the steel plate from which the clearance hole 20*g* (shown in FIG. 3) has been stamped out.

The rubber switch 42 is in contact on the switch's upper surface with the actuator section 30*f* that has been formed on the key and the dome shaped section of the rubber switch 42 swings and impels the key upward due to the elastic restorative force that the section possesses. In addition, two contacts are furnished in different key pressing positions on the rubber switch 42 that become connection conditions for the detection of the key speed and, due to the fact that when the key is pressed down, the dome shaped section of the rubber switch 42 swells and the two moveable contacts that are formed from conductive rubber sequentially come into contact with the fixed contacts that have been disposed on the printed wiring board 40*a*, the fixed contacts are brought into a conducting state. In those cases where the key is pressed, first, the first contact is brought into a conductive state and, following that, the second contact is changed to a conductive state. The velocity at the time of the key pressing is detected by the detection of the difference in the times that the two contacts change to a conductive state.

In addition, in those cases where the key is released, first, the second contact is brought into a non-conductive state and, following that, the first contact is changed to a non-conductive state. In this case also, in the same manner, the velocity at the time of the key releasing is detected by the detection of the difference in the times that the two contacts change to a non-conductive state.

The key guide receptacles or vertical key guide walls 30*p* are disposed on the white keys and the black keys on the inside of the keys and in the long direction of the keys and an opening or rectangular key guide hole 30*m* is formed in the key guide wall 30*p*. The movements in the vertical direction and in the horizontal direction of the key are regulated by means of the key guide hole 30*m* and the key guide bushing 22 that has been attached in the key guide 20*d*. The key guide bushing 22 is installed in the key guide 20*d* that has been bent processed such that the bushing cuts the bottom plate section 20*f* of the reinforcing member 20 and first is stood up roughly vertically from the bottom plate and in addition, the tip that has been stood up becomes roughly parallel to the bottom plate (refer to FIG. 5). In addition, the key stoppers 12 and 14 that comprise a buffering material such as felt and the like are disposed on the bottom plate member 10 in order to dampen the impact that is imparted by the key in those cases where the key has been pressed down to the lowest position.

The key stopper 12 is something that comes into contact with the key guide wall 30*p* and the linked wall 30*g* and is fixed by means of an adhesive in the depression 10*h* that has been formed one level lower than the bottom plate member 10 inside the long hole 20*f* that has been opened in order to form the key guide 20*d* from the reinforcing member 20.

The key stopper 14 is something that comes into contact with the tip section 30*n* of the key and is fixed by means of an adhesive to the bent section on the tip side of the key of the reinforcing member 10.

The protrusion 10*j*, which has a roughly rectangular cross-section extending in the direction that the keys are lined up, is disposed on the bottom plate member 10. The protrusion 10*j* is positioned below the fulcrum 30*k* that has been formed in the portion that is connected to the hinge section 30*i* of the main key body of the key. The protrusion 10*j* and the fulcrum 30*k* are usually separated but if the key is pressed down strongly, the fulcrum 30*k* comes into contact with the upper surface of the protrusion 10*j* and the regulation is done such that the hinge section 30*i* does not become lower than the position at which the protrusion 10*j* is supported. Because of this, a large force acting on and damaging the hinge section 30*i* is prevented. The same applies to the hinge section 30*c* of the white key unit 30 and the hinge section 32*c* of the black key unit 32.

Figure 5:
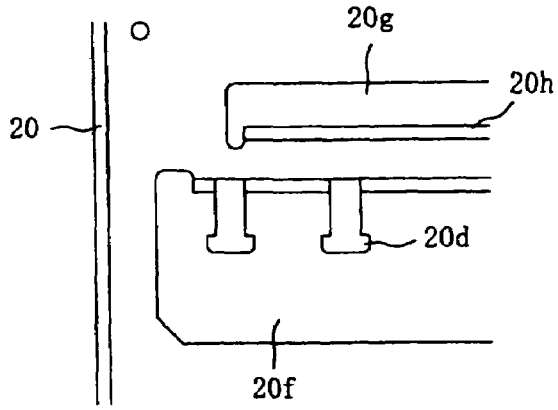
FIGS. 5(*a*), 5(*b*), and 5(*c*) are detailed drawings of a key guide of an embodiment of the invention, wherein FIG. 5(*a*) is a plane drawing of a portion of a reinforcing member of FIG. 3 that is encircled by a dotted line A, FIG. 5(*b*) is a plane drawing and a front elevation drawing of a key guide bushing, and FIG. 5(*c*) is a cross-section drawing that presents a cross-section view at B—B of FIG. 4.
Figure 5:
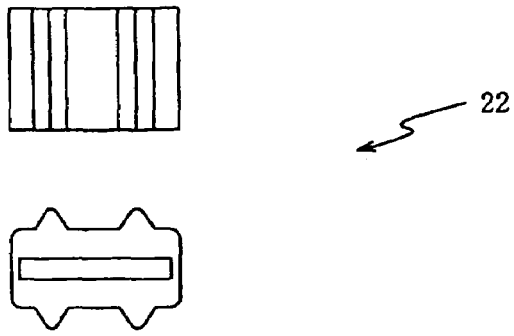
Figure 5:
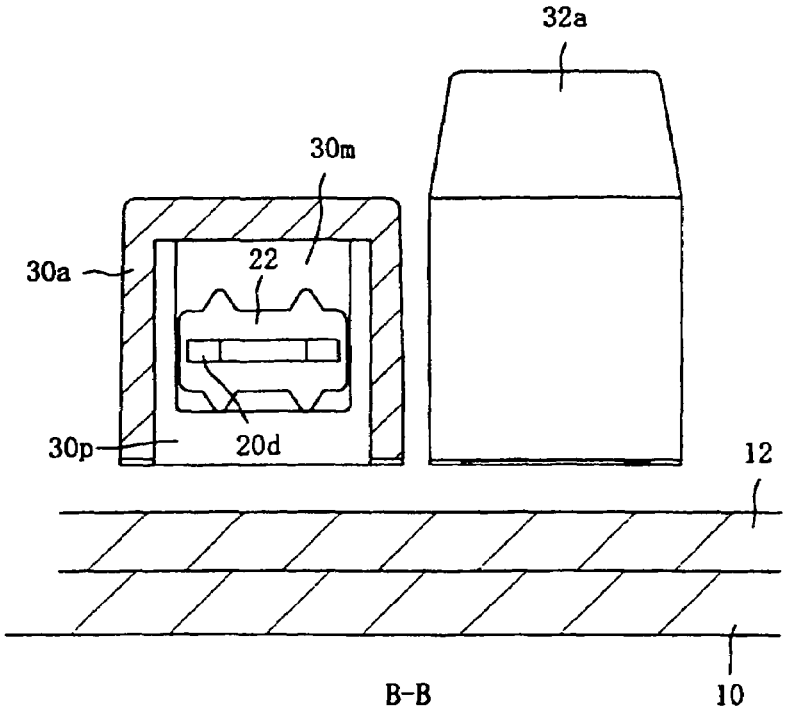

FIG. 5 is a drawing for an explanation of the details of key guide 20*d*. FIG. 5(*a*) is a plane drawing of the portion of the reinforcing member 20 of FIG. 3 that is encircled by the single dotted line A. In FIG. 3, the state in which the key guide bushing 22 has been attached only in the key guide 20*d* on the left end and the state in which the key guide bushing 22 is not attached in the remainder of the key guide 20*d* is shown. FIG. 5(*a*) shows the key guide 20*d* in which the key guide bushing 22 has not been attached. As is shown in the drawing, the key guide 20*d* has a tip that is formed in a tapered shape such that the key guide bushing 22 can be easily attached and a level difference is provided so that the key guide bushing 22 will not fall out when the key guide bushing 22 is attached.

FIG. 5(*b*) is a plane drawing (top) and a front elevation drawing (bottom) of the key guide bushing 22 and, as is shown in the front elevation drawing, an insertion hole into which the key guide 20*d* is inserted is formed in the center area, and two lines of peak shaped protrusions are formed respectively on the top and bottom. These protrusions are for dampening the impact in those cases where the key has' swung to the lower limit or the upper limit position.

FIG. 5(*c*) is a cross-section drawing that presents a cross-section view at B—B in FIG. 4 and shows the key guide bushing 22 that has been attached to the key guide 20*d* and the rectangular (including a square) key guide hole 30*m* that has been formed in the key guide wall 30*p* of the white key 30*a*. In the drawing, the case in which the key is maintained in the upper limit position is shown and the bottom edge of the rectangular key guide hole 30*m* comes into contact with the protrusions that have been formed on the bottom surface of the key guide bushing 22.

In those cases where the white key 30*a* swings up and down, since the left and right edges of the key guide bushing 22 move along the vertical sides of the rectangular key guide hole 30*m*, the left to right position of the key is regulated.

If the white key 30*a* has been pressed down, the upper side of the key guide hole 30*m* comes into contact with the protrusions that have been formed on the upper surface of the key guide bushing 22; and, together with this, the side wall and the vertical wall 30*g* of the white key 30*a* (refer to FIG. 4) come into contact with the cushion 12 that has been affixed on the bottom plate member 10 and the downward impact is dampened at the same time as the lower limit position of the key 30*a* is regulated. Accordingly, the operating properties are satisfactory and a moderate force acts that pushes back on the finger of the performer.

Figure 6:
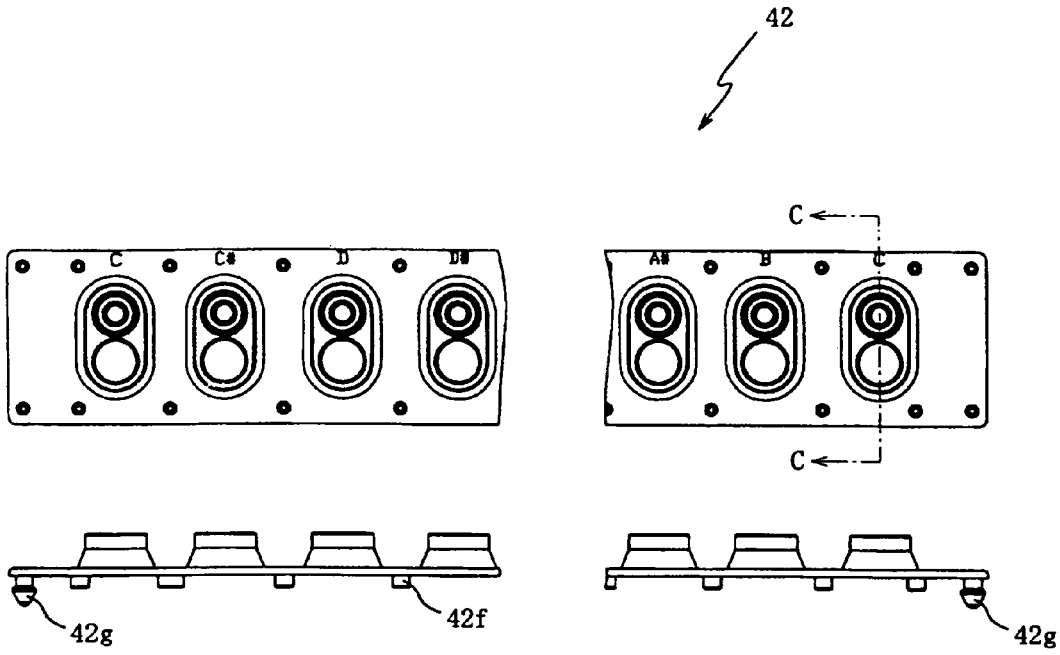
FIGS. 6(*a*) and 6(*b*) are detailed drawings of a rubber switch of an embodiment of the invention, wherein FIG. 6(*a*) is a plane drawing and a front elevation drawing of a rubber switch, and FIG. 6(*b*) is a cross-section drawing along C—C of FIG. 6(*a*)
Figure 6:
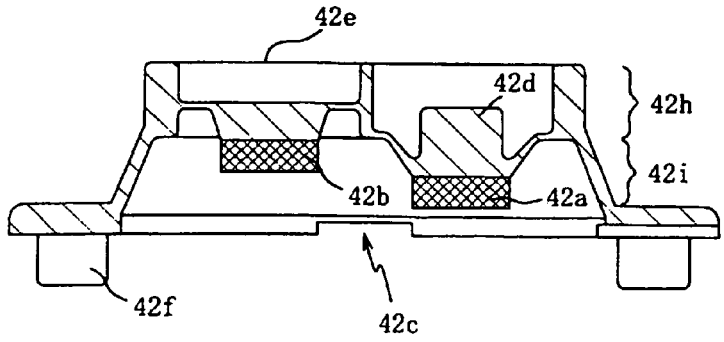

FIG. 6 is a drawing for the detailed explanation of the rubber switches 42. FIG. 6(*a*) is a plane drawing (top) and a front elevation drawing (bottom) of the rubber switches overall. The rubber switches 42 are switches that correspond to each of the total of 25 keys and are formed in a single unit. As is shown in the front elevation drawing, the protrusions 42*f* are formed on the bottom surface between each of the switches and these protrusions are inserted into the attachment holes that have been disposed in the printed wiring board 40*a*. Because the diameters of the protrusions are formed larger than the diameters of the attachment holes that have been disposed in the printed wiring board 40*a*, the rubber switches 42 are fixed and attached to the printed wiring board 40*a*. The protrusions 42*g* on both ends have tips that are formed especially thickly and are securely fixed and attached to the printed wiring board 40*a*. Because of this, the creation of a space between the rubber switches 42 and the printed wiring board 40*a* and the penetration of dust into the switches is prevented.

FIG. 6(*b*) is a cross-section drawing along C—C of FIG. 6(*a*). The switch is one in which the driven section 42*h* that comprises the first section or first cylindrical section, which has the first moveable contact 42*a*, and the second section or second cylindrical section, which has the second moveable contact 42*b*, and the skirt section 42*i* that supports the driven section 42*h* formed in a single unit from an elastic material (rubber). The first moveable contact 42*a* has the protrusion 42*d* that is formed on top of the contact.

In addition, the air hole 42*c* is formed in the area where the section between adjoining switches and the printed wiring board on the first contact side are joined and is configured such that the air is exhausted to the outside and taken in in conformance with the changes in the volume in the interior of the skirt section due to the pressing down of the key.

In FIG. 6, the protrusion 42*d* on top of the first moveable contact 42*a* has been formed in a single unit with the driven section 42*h* and the skirt section 42*i*, but the protrusion may also be disposed on the key side.

Figure 7:
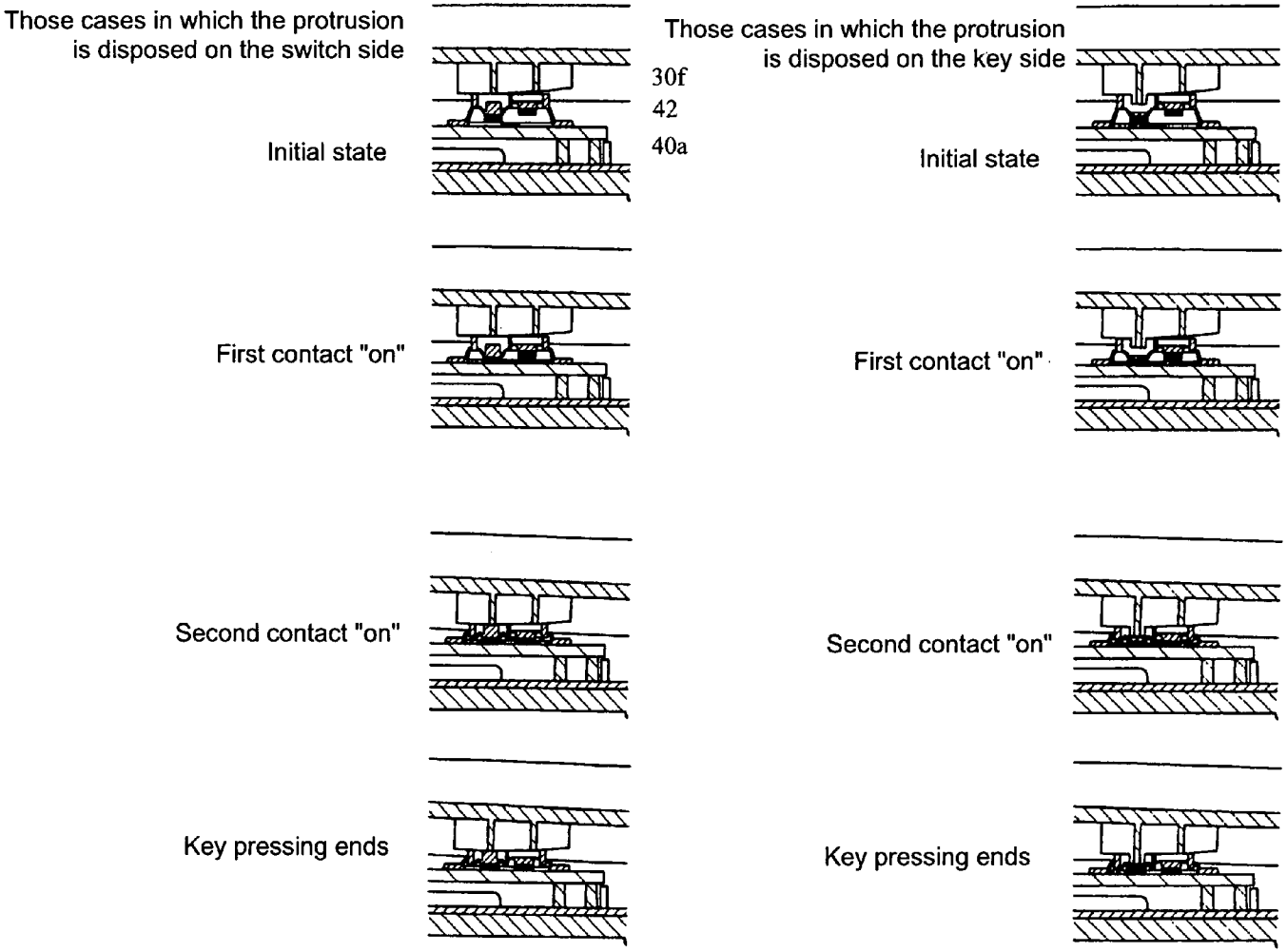
FIG. 7 is a drawing that shows aspects of changes in a rubber switch of an embodiment of the invention as a consequence of key pressing.

FIG. 7 shows the respective aspects in which the rubber switch 42 changes in conformance with the key pressing in those cases where the protrusion has been disposed on the switch and in those cases where the protrusion has been disposed on the key. It should be noted that reference numbers for portions of the rubber switch 42 that are to be discussed in connection with FIG. 7 are shown in FIG. 6(*b*). In those cases where the protrusion has been disposed on the switch, in the initial state or in the state immediately after the key pressing has been started, the actuator section 30*f* of the key presses on the upper surface of the driven section 42*h* of the rubber switch 42 but the rubber switch 42 is still in a state in which no change in shape has occurred.

When the pressing force becomes stronger, the skirt section 42*i* of the rubber switch begins to change shape and the first moveable contact 42*a* comes into contact with the first fixed contact that has been formed on the printed wiring board 40*a*. In this state, there is a space between the top of the protrusion 42*d* that has been formed on the top of the first moveable contact 42*a* and the actuator section 30*f* of the key and there is also a space between the second moveable contact 42*b* and the second fixed contact that has been formed on the printed wiring board 40*a*.

When the driven section 42*h* is driven further downward, the second moveable contact 42*b* comes into contact with the second fixed contact that has been formed on the printed wiring board 40*a*. Roughly at the same time as this, the actuator 30*f* of the key and the upper surface of protrusion 42*d* that has been formed on the top of the first moveable contact 42*a* come into contact. When the pressing force on the key is further increased, each section of the switch that is formed from an elastic material changes shape, the first moveable contact 42*a* and the second moveable contact press strongly on the first fixed contact and the second fixed contact that have been formed on the printed wiring board 40*a*, and the key pressing ends.

There is the same kind of action in those cases where the protrusion has been disposed on the actuator section 30*f* of the key also. The upper surface of the first moveable contact 42*a* and the lower surface of the protrusion that has been disposed on the actuator section 30*f* come into contact at roughly the same time as the second moveable contact 42*b* comes into contact with the printed wiring board 40*a* and presses on the first moveable contact 42*a*.

Accordingly, in either case, since the upper surface of the first moveable contact comes into contact with the key after the first moveable contact 40*a* once comes into contact with the fixed contact that has been disposed on the printed wiring board, it is possible to prevent the occurrence of chattering in the process in which the key is pressed down further.

An explanation was given above of the present invention based on embodiments. However, the present invention is in no way limited to the embodiments described above and the fact that various modifications and changes are possible that do not deviate from and are within the scope of the essentials of the present invention can be easily surmised.

For example, in the embodiments described above, an explanation has been given of a keyboard apparatus in which two contacts are disposed on one rubber switch and the key pressing speed is detected by the difference in the times that the contacts conduct. However, the present invention is also applicable to those cases in which one contact has been disposed on one rubber switch. In other words, the invention is valid also for the case in which the contact makes contact at a specified position of the key stroke, it is necessary to maintain the contact after that also, and there is chattering by the contact that occurs during that time.

In addition, it has been configured such that the key obtains the restorative force from the rubber switch, but it may also be done such that the restorative force is obtained from a spring and the like. In that case, it is not necessary that the driven section of the switch be in contact with the actuator section of the key when the key is released.

In addition, in the embodiments described above, an explanation has been given regarding the case in which a protrusion is disposed on the upper surface of the first moveable contact of the rubber switch 42 and the case in which a protrusion is disposed in the area of the key that corresponds to the first moveable contact. However, it may also be set up such that a protrusion is also disposed in the same manner for the second moveable contact and the occurrence of chattering by the second contact is prevented.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. A keyboard apparatus, comprising:

a switch that is formed from an elastic material in a single unit with a driven section and a skirt section, said driven section comprising a first section that has a moveable contact on the inside, said skirt section supporting the driven section;

a key supported for pivotal motion that drives the driven section; and a base plate that has a fixed contact, which has been formed opposite the moveable contact;

wherein in a state in which the key has started to drive the driven section, an open gap is disposed between an upper surface of the moveable contact and an area of the key that corresponds to the moveable contact, and after the moveable contact has come into contact with the fixed contact as a consequence of a pressing of the key, the area of the key that corresponds to the moveable contact applies a force on the upper surface of the moveable contact;

wherein the skirt section of the switch has attachment protrusions on a bottom surface that are inserted into attachment holes in the base plate; and wherein the switch has an air hole through which air is exhausted from an interior of the skirt section and is taken in to the interior of the skirt section in conformance with changes in a volume of the interior of the skirt section due to the pressing of the key.

2. The keyboard apparatus of claim 1, wherein a protrusion from the elastic material with which the switch is formed is disposed on the upper surface of the moveable contact of the switch.

3. The keyboard apparatus of claim 1, wherein a protrusion is disposed on the area of the key that corresponds to the moveable contact of the switch.

4. The keyboard apparatus of claim 1, wherein the first section of the driven section of the switch has a first surface that at least partially surrounds an interior space;

wherein, in the state in which the key has started to drive the driven section, the key contacts at least a portion of the first surface of the first section of the driven section while the open gap is disposed between the upper surface of the moveable contact and the area of the key that corresponds to the moveable contact; and wherein a protrusion is at least partially located within the interior space.

5. The keyboard apparatus of claim 4, wherein the protrusion is disposed on the upper surface of the moveable contact of the switch.

6. The keyboard apparatus of claim 5, wherein a height from a surface of the base plate to the first surface of the first section of the driven section of the switch is greater than a height from the surface of the base plate to an upper surface of the protrusion that is disposed on the upper surface of the moveable contact of the switch.

7. The keyboard apparatus of claim 5, wherein, in the state in which the key has started to drive the driven section, the key contacts at least the portion of the first surface of the first section of the driven section while the open gap is disposed between an upper surface of the protrusion that is disposed on the upper surface of the moveable contact of the switch and the area of the key that corresponds to the moveable contact.

8. The keyboard apparatus of claim 5, wherein the protrusion has a height such that after the moveable contact has come into contact with the fixed contact as a consequence of the pressing of the key, the area of the key that corresponds to the moveable contact comes into contact with an upper surface of the protrusion.

9. The keyboard apparatus of claim 4, wherein the protrusion is disposed on the area of the key that corresponds to the moveable contact of the switch.

10. The keyboard apparatus of claim 9, wherein, in a state in which the key is not driven, the protrusion that is disposed on the area of the key that corresponds to the moveable contact is at least partially located within the interior space that is at least partially surrounded by the first surface of the first section of the driven section.

11. The keyboard apparatus of claim 9, wherein the protrusion has a height such that after the moveable contact has come into contact with the fixed contact as a consequence of the pressing of the key, the protrusion comes into contact with the upper surface of the moveable contact of the switch.

12. The keyboard apparatus of claim 4, wherein the interior space includes a cylindrical volume that is at least partially surrounded by the first surface of the first section of the driven section.

13. A keyboard apparatus, comprising:

a switch that is formed from an elastic material in a single unit with a driven section and a skirt section, said driven section comprising a first section that has a first moveable contact and a second section that has a second moveable contact, said skirt section supporting the driven section;

a key supported for pivotal motion that drives the driven section; and a base plate that has a first fixed contact that has been formed opposite the first moveable contact and a second fixed contact that has been formed opposite the second moveable contact, and that has been configured such that first, the first moveable contact comes into contact with the first fixed contact and then the second moveable contact comes into contact with the second fixed contact in conformance with a pressing down of the key;

wherein in a state in which the driving of the driven section of the switch by the key has been started, an open gap is disposed between the first moveable contact and an area of the key that corresponds to the first moveable contact, and after the first moveable contact has come into contact with the first fixed contact in conformance with the pressing down of the key, the area of the key that corresponds to the first moveable contact applies a force on an upper surface of the first moveable contact; and wherein the switch is configured such that the area of the key that corresponds to the first moveable contact begins to apply the force on the upper surface of the first moveable contact in conformance with the pressing down of the key at roughly a same time that the second moveable contact comes into contact with the second fixed contact.

14. The keyboard apparatus of claim 13, wherein a protrusion from the elastic material with which the switch is formed is disposed on the upper surface of the first moveable contact of the switch.

15. The keyboard apparatus of claim 14, wherein the protrusion that is disposed on the upper surface of the first moveable contact of the switch has a height such that the area of the key that corresponds to the first moveable contact comes into contact with the protrusion so as to apply the force on the upper surface of the first moveable contact in conformance with the pressing down of the key at roughly the same time that the second moveable contact comes into contact with the second fixed contact.

16. The keyboard apparatus of claim 13, wherein a protrusion is disposed on the area of the key that corresponds to the first moveable contact of the switch.

17. The keyboard apparatus of claim 16, wherein the protrusion that is disposed on the area of the key that corresponds to the first moveable contact of the switch has a height such that the protrusion that is disposed on the area of the key that corresponds to the first moveable contact applies the force on the upper surface of the first moveable contact in conformance with the pressing down of the key at roughly the same time that the second moveable contact comes into contact with the second fixed contact.

18. The keyboard apparatus of claim 13, wherein an upper surface of the first section of the driven section is connected to an upper surface of the second section of the driven section in an area that is between the skirt section and the key.

19. A keyboard apparatus, comprising:

a key operable to pivot between a first position, a second position, and a third position;

a first fixed contact;

a second fixed contact; and a switch located beneath the key and above the first fixed contact and the second fixed contact, the switch comprising a driven section, the driven section comprising an upper surface, a first movable contact, and a second moveable contact, the first movable contact located beneath a first region of the key, the second moveable contact located beneath a second region of the key;

wherein when the key pivots from the first position to the second position, the key presses on the upper surface of the driven section so that the first movable contact comes into contact with the first fixed contact, but an open gap exists between the first region of the key and the first movable contact;

wherein when the key pivots from the second position to the third position, the first region of the key applies a force to the first movable contact at roughly a same time that the second moveable contact comes into contact with the second fixed contact;

wherein the upper surface of the driven section at least partially surrounds an interior space; and wherein a protrusion is at least partially located within the interior space.

20. The keyboard apparatus of claim 19, wherein the protrusion is formed on the first moveable contact; and wherein when the key pivots from the second position to the third position, the first region of the key comes into contact with the protrusion formed on the first movable contact.

21. The keyboard apparatus of claim 20, wherein the protrusion formed on the first moveable contact has a height such that when the key pivots from the second position to the third position, the first region of the key comes into contact with the protrusion formed on the first moveable contact so as to apply the force to the first movable contact at roughly the same time that the second moveable contact comes into contact with the second fixed contact.

22. The keyboard apparatus of claim 19, wherein the first movable contact is located to a side of the second movable contact and is located lower than the second movable contact when the key is not pressed.

23. The keyboard apparatus of claim 19, wherein the key comprises:

a key body;

the protrusion, said protrusion extending from the key body and located above the first movable contact; and a second protrusion extending from the key body and located above the second movable contact.

24. The keyboard apparatus of claim 23, wherein the protrusion is longer than the second protrusion.

25. The keyboard apparatus of claim 23, wherein the protrusion extending from the key body has a height such that when the key pivots from the second position to the third position, the protrusion applies the force to the first movable contact at roughly the same time that the second moveable contact comes into contact with the second fixed contact.

26. The keyboard apparatus of claim 19, wherein a difference between a time that the first movable contact comes into contact with the first fixed contact and the time that the second movable contact comes into contact with the second fixed contact, is used to determine a key pressing speed.

27. The keyboard apparatus of claim 19, wherein the protrusion is disposed on an upper surface of the first moveable contact.

28. The keyboard apparatus of claim 27, wherein the first moveable contact is supported on a lower surface of the protrusion, said protrusion having an upper surface opposite the lower surface;

wherein the first region of the key is located on a bottom surface of the key; and wherein, when the key is not pivoted, a distance from the upper surface of the driven section to the bottom surface of the key is less than a distance from the upper surface of the protrusion to the bottom surface of the key.

29. The keyboard apparatus of claim 27, wherein, when the key pivots from the first position to the second position, the key presses on the upper surface of the driven section, but the open gap exists between the first region of the key and the protrusion.

30. The keyboard apparatus of claim 27, wherein the protrusion has a height such that when the key pivots from the second position to the third position, the first region of the key contacts the protrusion at roughly the same time that the second moveable contact comes into contact with the second fixed contact.

31. The keyboard apparatus of claim 19, wherein the protrusion is a portion of the key that includes the first region of the key.

32. The keyboard apparatus of claim 31, wherein, when the key is in the first position, the protrusion is at least partially located within the interior space that is at least partially surrounded by the upper surface of the driven section.

33. The keyboard apparatus of claim 31, wherein the protrusion has a height such that when the key pivots from the second position to the third position, the protrusion applies a force to the first moveable contact at roughly the same time that the second moveable contact comes into contact with the second fixed contact.

* * * * *